US005758432A

United States Patent [19]

Landman

[11] Patent Number: 5,758,432

[45] Date of Patent: Jun. 2, 1998

[54] INITIATOR POSITIONING TOOL

[75] Inventor: Charles William Landman, Callao, Va.

[73] Assignee: The United States of America as represented by the Secretary of the Navy, Washington, D.C.

[21] Appl. No.: 696,083

[22] Filed: Aug. 13, 1996

[51] Int. Cl.[6] ..... G01D 21/00

[52] U.S. Cl. ..... 33/613; 33/506

[58] Field of Search ..... 33/613, 528, DIG. 10, 33/652, 506; 102/275.11, 275.12, 275.5

[56] References Cited

U.S. PATENT DOCUMENTS

| | | | |
|---|---|---|---|
| 2,404,858 | 7/1946 | MLaren | 33/613 |
| 2,798,300 | 7/1957 | Eisele | 33/652 |
| 2,896,334 | 7/1959 | Dunderman | 33/652 |
| 2,919,913 | 1/1960 | Phair | 33/DIG. 10 |
| 2,956,798 | 10/1960 | Briggs | 33/DIG. 10 |
| 3,552,734 | 1/1971 | Severino et al. | 33/613 |
| 4,947,616 | 8/1990 | Sorton | 33/613 |
| 5,072,523 | 12/1991 | Bennett | 33/528 |
| 5,493,973 | 2/1996 | Brion et al. | 102/431 |
| 5,630,281 | 5/1997 | Pledger et al. | 33/528 |

*Primary Examiner*—Thomas B. Will
*Attorney, Agent, or Firm*—James B. Bechtel, Esq.

[57] ABSTRACT

A tool is provided for the consistent positioning of a tube initiator against the inside wall of a casing of an explosive device a fixed height above the bottom of the casing. The tool has a base plate with at least one hole formed therein that is sized to form an interference fit with the end(s) of the tube initiator that will reside within the device's explosive material. A spacer is attached to the plate and extends away from the plate in the same direction as the tube initiator. A handle or grip is attached to the plate and extends away from the plate in a direction opposite that of the spacer.

20 Claims, 3 Drawing Sheets

INITIATOR POSITIONING TOOL

ORIGIN OF THE INVENTION

The invention described herein was made in the performance of official duties by an employee of the Department of the Navy and may be manufactured, used, licensed by or for the Government for any governmental purpose without payment of any royalties thereon.

1. Field of the Invention

The invention relates generally to tools used in the manufacture of explosive devices, and more particularly to an initiator positioning tool for the simple and consistent placement of a tube-type initiator in the casing of an explosive device such as a warhead.

2. Background of the Invention

The position of an explosive device's detonator or initiator can be critical to achieve a desired explosive reaction. When constructing a number of identical explosive devices, it is desirable to achieve consistency in all phases of construction and especially the placement of the device's initiator(s). This is necessary to provide performance predictability and to satisfy safety criteria that has been based on such predicted performance.

The U.S. Navy is currently developing a directional ordinance system which requires one or more tube-type initiators to be positioned on the side wall of the warhead body. Each initiator must be fixed against the side wall a fixed height above the bottom of the warhead body before the warhead body is filled with explosive material. Typically, the fixed height is measured and marked on the side wall and each initiator is then attached to the side wall in accordance with such marking. However, this is time consuming and prone to human error both in the measuring and marking of the side wall, and then the actual positioning of the initiator in accordance with such marking. This ultimately leads to inconsistencies in the explosive reaction of the device which can affect performance and/or safety of the device.

SUMMARY OF THE INVENTION

Accordingly, it is an object of the present invention to provide a tool that eliminates human error in the positioning of a tube-type initiator in a warhead body.

Another object of the present invention to provide a tool that reduces the time it takes to position a tube-type initiator against the side wall of a warhead body while achieving consistent results with each use thereof.

Other objects and advantages of the present invention will become more obvious hereinafter in the specification and drawings.

In accordance with the present invention, a tool positions a tube initiator against the inside wall of a casing of an explosive device a fixed height above the bottom of the casing. The tube initiator has a first end and at least one second end. The tube initiator is shaped at a portion thereof between the first second end(s) such that an angle of approximately 90° is formed between the first and second end(s). The tool has a base plate with at least one hole formed therein that is sized to form an interference fit with the second end(s). The tube initiator extends a distance away from the plate with the second end(s) inserted into the hole(s) in the plate. This distance is measured perpendicular to the plate and extends to an outside edge of the tube initiator. A spacer is attached to the plate and extends away from the plate in the same direction as the tube initiator by an amount approximately equal to the distance. A handle or grip is attached to the plate and extends away from the plate in a direction opposite that of the spacer.

DETAILED DESCRIPTION OF THE INVENTION

Figure 1:
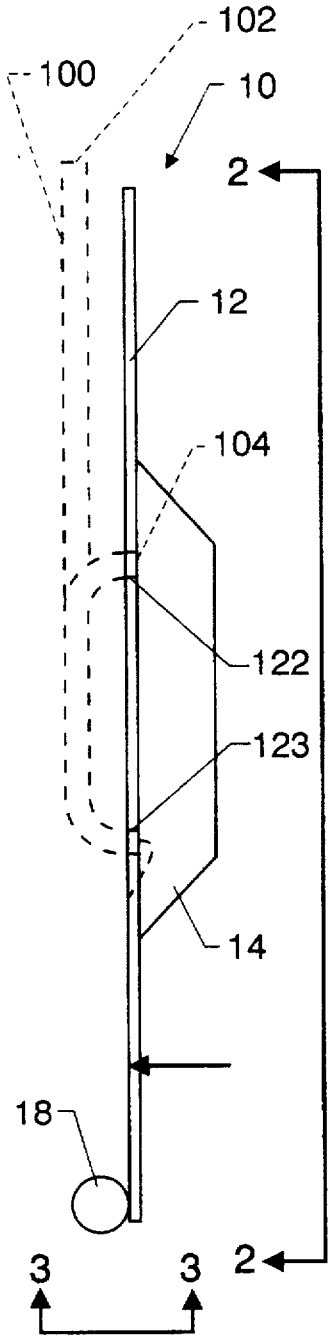
FIG. 1 is a side view of the initiator positioning tool in accordance with a preferred embodiment of the present invention for use with a tube-type initiator shown in FIGS. 4A and 4B.
Figure 2:
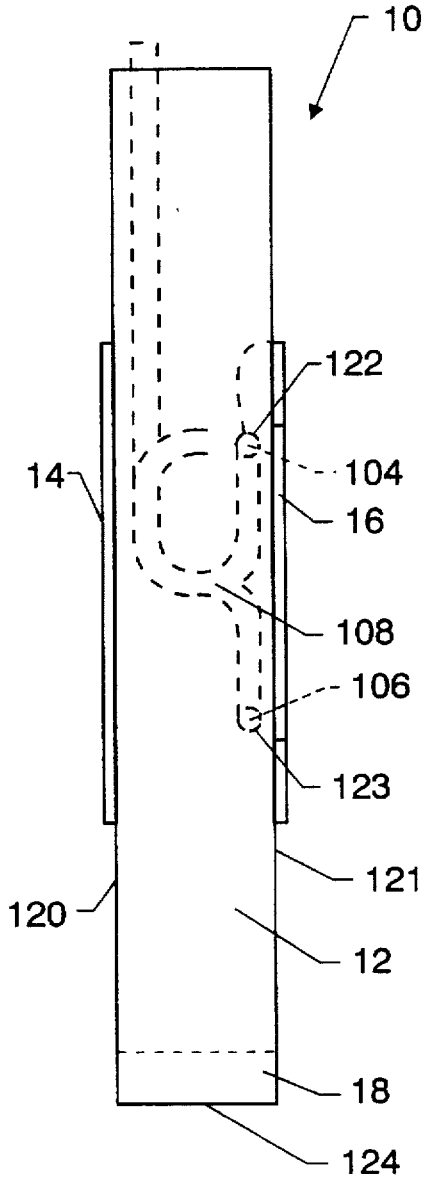
FIG. 2 is a plan view of the initiator positioning tool taken along line 2—2 of FIG. 1.
Figure 3:
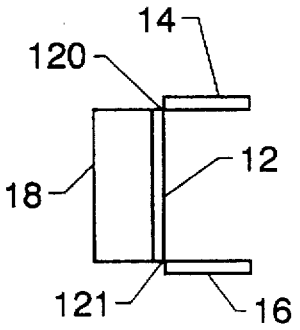
FIG. 3 is an end view of the initiator positioning tool taken along line 3—3 of FIG. 1.
Figure 4A:
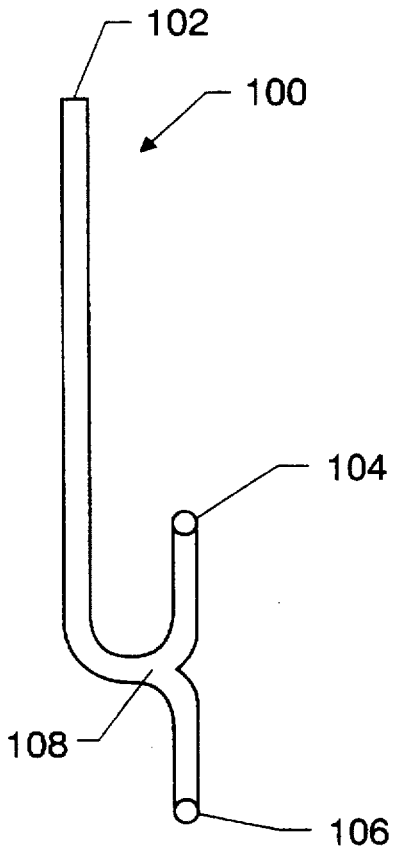
FIG. 4A is a plan view of an example of a tube-type initiator that is to be positioned by the tool of the present invention.
Figure 4B:
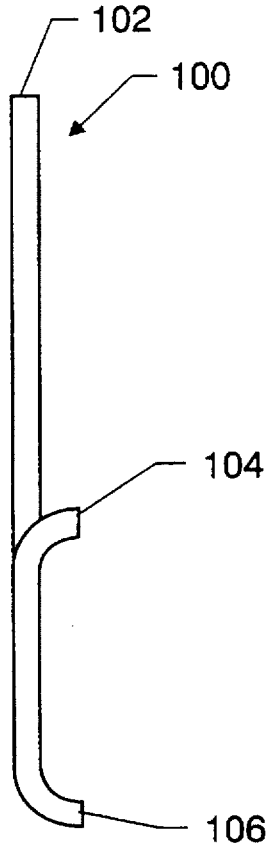
FIG. 4B is a side view of the tube-type initiator shown in FIG. 4A.

Referring now to the drawings, and more particularly to FIGS. 1–3, three views of a preferred embodiment of the initiator positioning tool of the present invention are shown and referenced generally by numeral 10. The same reference numerals will be used for the elements common to each view. By way of illustrative example, tool 10 will be described for use with a tube initiator 100 (shown in phantom in FIGS. 1 and 2) that is used in the U.S. Navy's directional ordinance system. Tube initiator 100 is shown in a plan view and a side view in FIGS. 4A and 4B, respectively. Although tool 10 will be described for use with initiator 100, it will be apparent to one of ordinary skill in the art that simple modifications of tool 10 can be made to accommodate other tube initiators without departing from the scope of the present invention.

Briefly, initiator 100 is made from stainless steel tubing (e.g., 0.25 inches outside diameter) that is to be filled with a primer explosive (not shown). Initiator 100 is defined by a first (open) end 102 and one or more second (open) ends of which there are two for initiator 100 as designated by reference numerals 104 and 106. Regardless of the number of such second ends (e.g., ends 104 and 106), the tubing is typically shaped at a portion 108 thereof to create a relative angle of approximately 90° between first end 102 and each of second ends 104 and 106. The tubing from first end 102 to shaped portion 108 is typically straight as is the tubing from shaped portion 108 to each of second ends 104 and 106. At detonation, the primer explosive in initiator 100 is ignited at end 102. The resulting detonation charge propagates through initiator 100 and into a main explosive as is known in the art. Multiple second ends (e.g., ends 104 and 106) are typically used to reduce the risk of detonation failure.

For use with initiator 100 (or any other similar tube-type initiator), tool 10 includes a bottom or base plate 12, side plates 14 and 16, and a spacer 18. Each of plates 12, 14, 16 and spacer 18 is typically made from a rigid material, e.g., steel, aluminum, composite, etc. Base plate 12 is generally oblong, e.g., rectangular, with its long sides 120 and 121 having a length sufficient to support initiator 100 and to position initiator 100 properly in an explosive's casing as will be explained further below. Holes 122 and 123 are provided in base plate 12 to accommodate second ends 104 and 106 of initiator 100. In general, the number and spacing of such holes in base plate 12 corresponds to the number and spacing of second ends of the initiator. Each of holes 122 and 123 is sized to form a slight interference fit with second ends 104 and 106, respectively. In this way, tool 10 can support initiator 100 with its straight section between first end 102 and shaped portion 108 maintained approximately parallel with base plate 12 as best seen in FIG. 1. For the illustrated embodiment, holes 122 and 123 are aligned equidistant from long side 121 and are positioned closer to long side 121 so that the entire width of initiator 100 is accommodated by the width of tool 10 as best seen in FIG. 2.

Plates 14 and 16 form finger grips or handles by which a user grasps tool 10 during the use thereof. As shown, each of plates 14 and 16 is a flat trapezoidal plate attached (e.g., glued, welded, etc.) to a respective long side 120 and 121 of plate 12. However, plates 14 and 16 can be any other shape (e.g., rectangle, half circle, etc.) that forms suitable finger grips. For best operation of tool 10, plates 14 and 16 are positioned parallel to one another and such that holes 122 and 123 are approximately centered relative to the length of plates 14 and 16.

Spacer 18 is attached (e.g., glued, welded, etc.) to base plate 12 to extend from the face thereof from which initiator 100 extends as best seen in FIG. 1. Spacer 18 is sized so that it extends from base plate 12 the same distance D as initiator 100 when initiator 100 is supported by tool 10 as shown in FIG. 1. In the preferred embodiment, spacer 18 is a cylindrical rod attached across the entirety of a short side 124 of base plate 12.

Figure 5B:
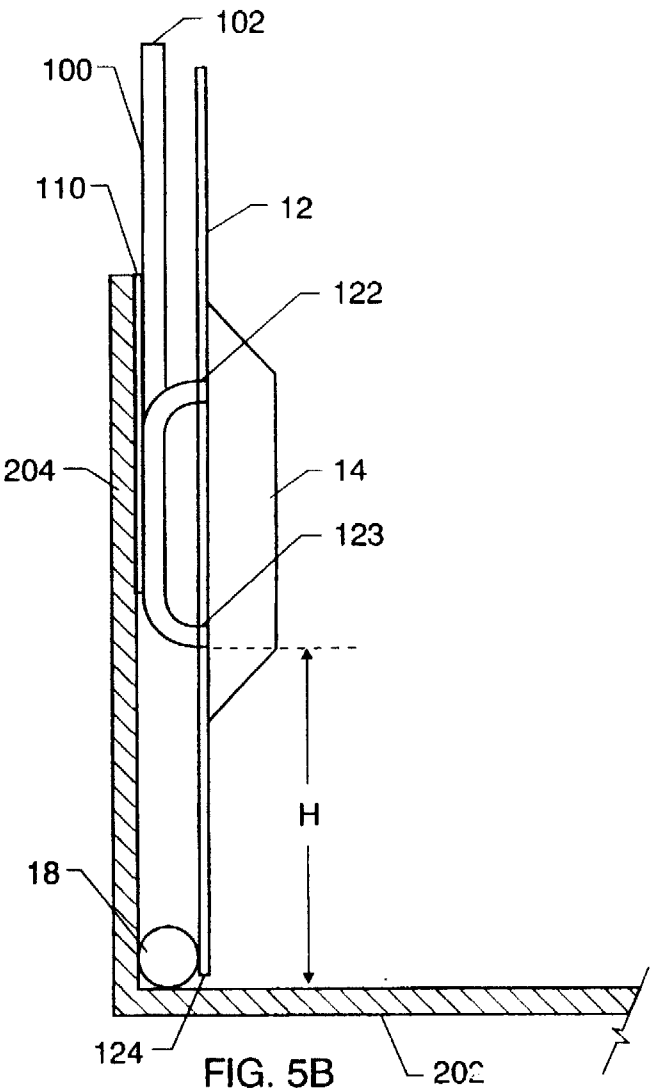
FIG. 5B depicts the initiator positioning tool after the tube-type initiator has been positioned against the side wall of the warhead body.
Figure 5A:
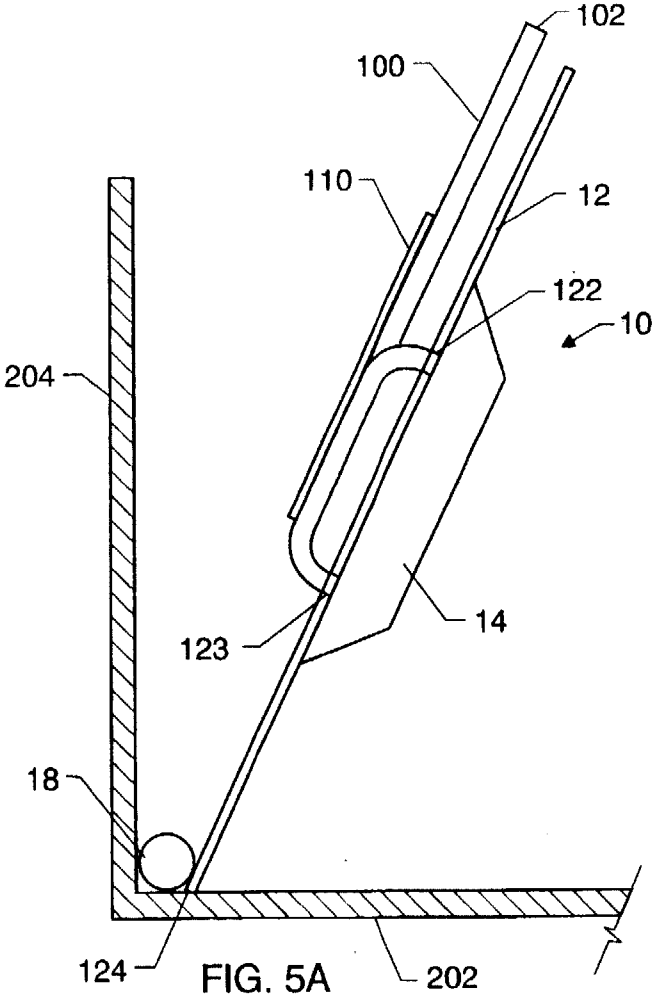
FIG. 5A depicts the initiator positioning tool with the tube-type initiator cooperating therewith as they are first placed inside the warhead body which is shown in cross-section.

Referring now to FIGS. 5A and 5B, the use of tool 10 will be described for positioning initiator 100 against the side wall of an explosive casing, e.g., a warhead body. More specifically, the casing has a bottom 202 and side wall 204. Tool 10 is shown supporting initiator 100 as described above. In FIG. 5A, the user (not shown) grasps tool 10 by plates 14 and 16 and places spacer 18 at the intersection of bottom 202 and side wall 204. It will be assumed herein that an adhesive material 110 (e.g., quick-setting glue, double-sided tape, etc.) has been applied to the straight portion of initiator 100 (between first end 102 and shaped portion 108) that faces side wall 204. With spacer 18 positioned at the intersection of bottom 202 and side wall 204, the user pivots tool 100 and initiator 100 about spacer 18 so that initiator 100 comes into contact with side wall 204 as shown in FIG. 5B. Such pivoting action is greatly facilitated when spacer 18 is a cylindrical rod as in the preferred embodiment. The size, i.e., diameter, of spacer 18 assures that the user achieves even adhesion pressure along the straight section of initiator 100 between first end 102 and shaped portion 108. This is because spacer 18 is sized to keep base plate 12 and the straight section of initiator 100 (which are approximately parallel to one another) parallel to side wall 204. The height H between short side 124 and the beginning of hole 123 defines a fixed height above bottom 202 that initiator 100 is to be positioned. Once initiator 100 is in position, the user simply pulls tool 10 away from initiator 100 using plates 14 and 16. This is easily achieved because a large portion of initiator 100 is adhered to side wall 204, because plates 14 and 16 are positioned in the vicinity of holes 122 and 123, and because the slight interference fit force provided by holes 122 and 123 is selected to be less than the adhesion force holding initiator 100 against side wall 204.

The advantages of the present invention are numerous. Tool 10 is simple in construction and is easy to use while guaranteeing consistent positioning of a tube initiator against a casing's sidewall a fixed height above the casing's bottom. The resulting consistency of explosive detonation will improve performance and safety of the ultimate explosive.

Figure 6:
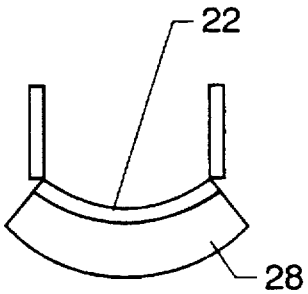
FIG. 6 is an end view of an alternative embodiment initiator positioning tool.

Although the invention has been described relative to a specific embodiment thereof, there are numerous variations and modifications that will be readily apparent to those skilled in the art in light of the above teachings. For example, if the wall against which the initiator is to be positioned is curved as in the case of a cylindrical casing, the base plate and spacer can have a corresponding curvature. This alternative is shown in FIG. 6 where base plate 22 is curved as is spacer 28 which can be a cylindrical rod as described above. Note that if the curvature of the casing's wall is slight, such shaping of the base plate and spacer is not necessary. Further, if such curvature is desired or required, it may only be necessary to shape the base plate in the vicinity of the spacer. It is therefore to be understood that, within the scope of the appended claims, the invention may be practiced other than as specifically described.

What is claimed as new and desired to be secured by Letters Patent of the United States is:

1. A tool for positioning a tube initiator against the inside wall of a casing of an explosive device a fixed height above the bottom of said casing, said tube initiator having a first end and at least one second end wherein said tube initiator is shaped at a portion thereof between said first end and said at least one second end such that an angle of approximately 90° is formed between said first end and said at least one second end, said tool comprising:

a plate having at least one hole formed therein and sized to form an interference fit with said at least one second end, wherein said tube initiator extends a distance away from said plate when said at least one second end is inserted into said at least one hole, said distance being measured perpendicular to said plate and extending to an outside edge of said tube initiator;

a spacer attached to said plate, said spacer extending away from said plate in the same direction as said tube initiator and in an amount approximately equal to said distance; and grip forming means attached to said plate and extending away from said plate in a direction opposite that of said spacer.

2. A tool as in claim 1 wherein said plate is oblong and defines a first long side and a second long side.

3. A tool as in claim 2 wherein said grip forming means comprises:

a first side plate attached along said first long side of said plate; and a second side plate attached along said second long side of said plate.

4. A tool as in claim 3 wherein said at least one hole is approximately centered between the length of said first side plate and the length of said second side plate.

5. A tool as in claim 1 wherein said spacer is attached to one end of said plate.

6. A tool as in claim 5 wherein said spacer is a cylindrical rod.

7. A tool as in claim 6 wherein said spacer spans substantially across the width of said plate.

8. A tool as in claim 5 wherein said one end of said plate is curved to match a curvature of said casing.

9. A tool as in claim 8 wherein said spacer is a cylindrical rod curved to match said curvature of said casing.

10. A tool for positioning a tube initiator against the inside wall of a casing of an explosive device a fixed height above the bottom of said casing, said tube initiator having a first straight section coupled to a plurality of second straight sections by an angle forming section wherein said first straight section forms an angle of approximately 90° with each of said plurality of second straight sections, said tool comprising:

a rigid base having a plurality of holes formed therethrough, each of said plurality of holes positioned to receive an end of a corresponding one of said plurality of second straight sections, each of said plurality of holes sized to form an interference fit with said end of a corresponding one of said plurality of second straight sections such that said tube initiator is supported by said base, wherein said tube initiator extends a distance away from said base when each said end of said plurality of second straight sections is inserted into a corresponding one of said plurality of holes, and wherein said first straight section is maintained in a substantially parallel relationship with said base, said distance being measured perpendicular to said base and extending to an outside edge of said tube initiator;

a spacer attached to said base, said spacer extending away from said base in the same direction as said tube initiator and in an amount approximately equal to said distance; and grip forming means attached to said base and extending away from said base in the vicinity of said plurality of holes and in a direction opposite that of said spacer.

11. A tool as in claim 10 wherein said base is flat, rectangular plate having a first long side, a second long side, a first short side and a second short side.

12. A tool as in claim 11 wherein said grip forming means comprises:

a first side plate attached along said first long side of said base; and a second side plate attached along said second long side of said base.

13. A tool as in claim 12 wherein said first side plate is parallel to said second side plate.

14. A tool as in claim 12 wherein said plurality of holes are approximately centered between the length of said first side plate and the length of said second side plate.

15. A tool as in claim 11 wherein said first straight section of said tube initiator extends toward said first short side when said tube initiator is supported by said base, and wherein said spacer is attached to said second short side.

16. A tool as in claim 15 wherein said spacer is a cylindrical rod.

17. A tool as in claim 16 wherein said spacer spans substantially across the width of said second short side.

18. A tool as in claim 10 said base is oblong and defines a first short side and a second short side, wherein at least said second short side is curved to match a curvature of said casing.

19. A tool as in claim 18 wherein said first straight section of said tube initiator extends toward said first short side when said tube initiator is supported by said base, and wherein said spacer is attached to said second short side.

20. A tool as in claim 19 wherein said spacer is a cylindrical rod curved to match said curvature of said casing.

* * * * *